175-50 SR
9/11/79 XR 4,167,290

United States Patent [19]
Yamazaki et al.
[11] 4,167,290
[45] Sep. 11, 1979

[54] SHIELD TYPE HYDRAULIC TUNNEL BORING MACHINE

[75] Inventors: Hironobu Yamazaki, Kashiwa; Eiji Sugino, Tokyo; Yoshiaki Yuchida, Koshigaya, all of Japan

[73] Assignee: Tekken Construction Co. Ltd., Tokyo, Japan

[21] Appl. No.: 839,278

[22] Filed: Oct. 4, 1977

[30] Foreign Application Priority Data

Mar. 11, 1977 [JP] Japan ..... 52-26047

[51] Int. Cl.² ..... E21D 9/04; E21D 9/12

[52] U.S. Cl. ..... 299/1; 175/50; 299/30; 405/132

[58] Field of Search ..... 299/1, 30; 175/50; 250/254; 61/84, 85; 181/102, 105

[56] References Cited

U.S. PATENT DOCUMENTS

| | | | |
|---|---|---|---|
| 3,346,299 | 10/1967 | Meyer | 175/50 X |
| 3,578,807 | 5/1971 | Barrett | 299/1 |
| 3,591,235 | 7/1971 | Addison | 299/1 |
| 3,719,394 | 3/1973 | Hartley | 299/1 |
| 3,817,578 | 6/1974 | Wilson | 299/1 |
| 3,823,787 | 7/1974 | Haworth et al. | 299/1 X |
| 3,853,185 | 12/1974 | Dahl et al. | 299/1 X |
| 3,961,307 | 6/1976 | Hochheimer et al. | 299/1 X |
| 3,961,683 | 6/1976 | Delignieres | 181/105 |
| 4,040,666 | 8/1977 | Uchida et al. | 299/1 |

FOREIGN PATENT DOCUMENTS

| | | | |
|---|---|---|---|
| 1234675 | 6/1971 | United Kingdom | 299/1 |

*Primary Examiner*—Ernest R. Purser
*Assistant Examiner*—Nick A. Nichols, Jr.
*Attorney, Agent, or Firm*—Burns, Doane, Swecker & Mathis

[57] ABSTRACT

A shield type hydraulic tunnel boring machine having means for detecting an occurrence of excess excavation due to accidental collapse in tunnel face ground apt to occur during tunnel boring works through soft and unstable ground and for further determining the location, shape, scale and the like of such excess excavation occurred is provided. The means comprises optimumly a plurality of ultrasonic wave transmitting and receiving devices disposed as spaced at least along a radial line on the front surface of a substantially disk shaped rotary cutter head of the machine for transmitting ultrasonic waves in forward and upward directions and receiving reflected waves from tunnel face ground wall, a wave transmission and reception controlling means, and a transmission-to-reception time interval detecting means for determining distances from the respective wave transmitting and receiving devices to the ground wall. The wave transmitting and receiving devices include ones oriented in diagonally angled directions with respect to the axial line of the machine shield to cover diagonal upward range in front of the cutter head, detected time interval values of which are further modified depending on the diagonal angles of these devices to determine the heights of the ground wall in the diagonally upward directions. The respective detected values of the plurality of the devices are scanned to determine the location, shape, scale and the like of the excess excavation.

7 Claims, 5 Drawing Figures

Fig. 1
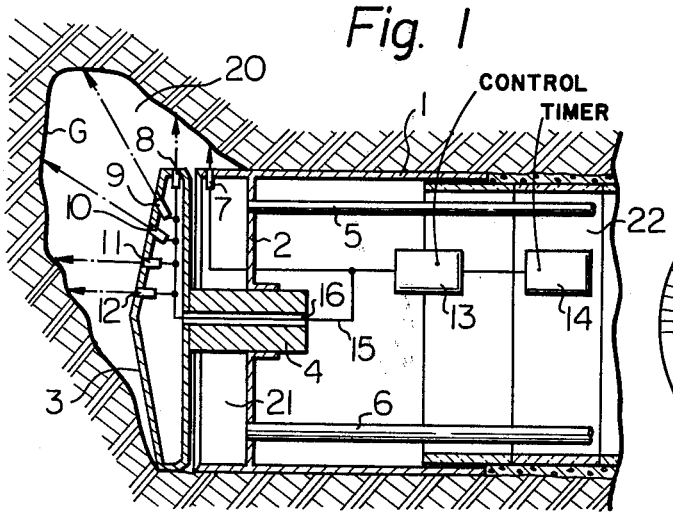
Fig. 2
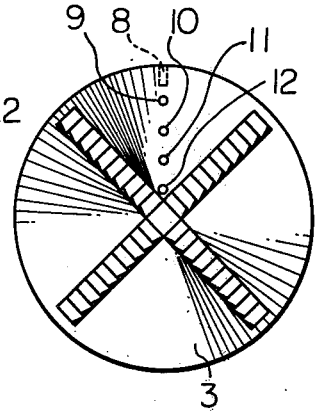
Fig. 3
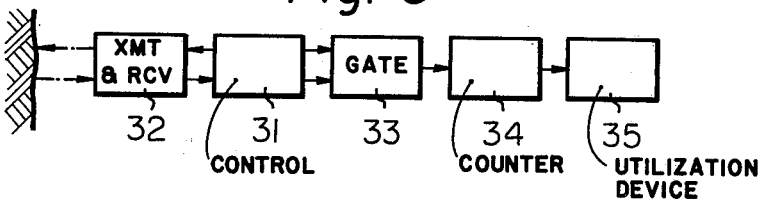
Fig. 4
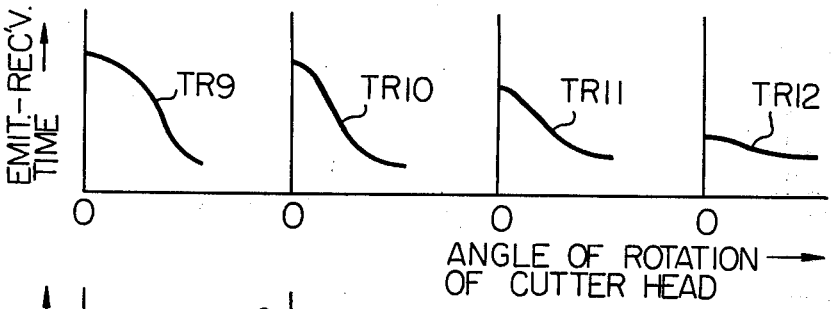
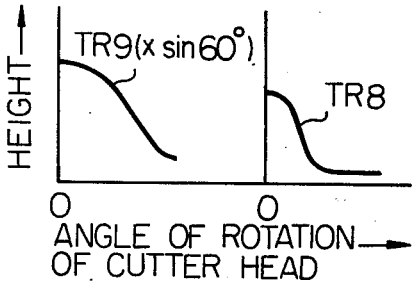
Fig. 5

SHIELD TYPE HYDRAULIC TUNNEL BORING MACHINE

FIELD OF THE INVENTION

This invention relates in general to shield type tunnel boring machines and, more particularly, to improvements in shield type hydraulic tunnel boring machines which are capable of accurately detecting occurrences, shapes, scales and the like of any excess excavation due to accidental tunnel face collapses of soft and unstable ground.

BACKGROUND OF THE INVENTION

Hitherto, in the shield tunnel boring machines for boring tunnels through soft and unstable ground in which the inner space of shield body is partitioned by a bulkhead at a position behind a rotary cutter head of the forward end of the shield body for boring the tunnel face ground, it has been practically impossible to directly observe or accurately reliably grasp actual state of any accidental collapses of tunnel face ground in excess of actual excavating amount being performed (which shall be referred to as "excess excavation" hereinafter) which are frequently occurring during the tunnel boring works through the soft and unstable ground. Specifically in the case of the hydraulic type boring machines utilizing generally muddy water as a liquid for hydraulic boring of the ground, such muddy water is completely opaque when excavated ground formations are mixed therewith so that direct observation of the tunnel face state can never be achieved even if an observing window is provided in the bulkhead. For this reason, there have been suggested certain measures of determining the occurrence of the excess excavation based on rapid change or increase in excavated ground formations which are drained out of the tunnel face together with the muddy water fed to the face but, with these measures, still it has been impossible to promptly determine the occurrence of the excess excavation since the measurements of the drained ground formation amount involve an inherent time lag due to existing distance between the tunnel face and actual measuring position of the drained ground formation amount and, further, practically impossible to detect or measure the location, shape and the like of the excess excavation only depending on the varying amount of the drained ground formations.

SUMMARY OF THE INVENTION

A primary object of the present invention is, therefore, to provide a shield type hydraulic tunnel boring machine which is capable of promptly detecting an occurrence of the excess excavation without substantial delay.

Another object of the present invention is to provide a shield type hydraulic tunnel boring machine capable of measuring accurately the location, shape and scale of the excess excavation as soon as it occurs during the tunnel boring work.

A further object of the present invention is to provide a shield type hydraulic tunnel boring machine that allows a continuous watching of actual state of the tunnel face ground to be performed during the boring operation so that any occurrence of the excess excavation can be immediately detected with its actual location, shape and scale and the boring operation can be continued while performing proper measures against such detected excess excavation.

BRIEF DESCRIPTION OF THE DRAWINGS

Other objects and advantages of the present invention shall be made clear as the following description of preferred embodiments of the invention advances with reference to accompanying drawings, in which:

FIG. 1 is a schematic vertical section of an embodiment of the shield type hydraulic tunnel boring machine in use according to the present invention;

FIG. 2 is a front elevation of the machine shown in FIG. 1;

FIG. 3 is a block diagram showing an example of controlling mechanism for excess excavation detecting and measuring means employed in the machine according to the present invention of FIG. 1;

FIG. 4 is a diagram showing respective curves of ultrasonic wave transmitting and receiving time intervals with respect to angles of rotation of cutter head, which are representing distances between respective ultrasonic wave transmitting and receiving devices provided in the cutter head of the machine in FIG. 1 and respective positions on tunnel face ground wall involving an excess excavation substantially in front of the cutter head; and FIG. 5 is a diagram showing similar curves to those in FIG. 4 but representing heights of the ground wall of an excess excavation cavity caused specifically on the upper side of the cutter head and machine of FIG. 1.

DETAILED DESCRIPTION OF THE INVENTION

Referring to FIGS. 1 and 2, a forward end side of a substantially cylindrical shield body 1 of the hydraulic tunnel boring machine is partitioned by a bulkhead 2 defining a hydraulic chamber 21 behind a rotary cutter head 3 which is rotatably born at its rotary shaft 4 in the center of the bulkhead 2 so as to be positioned at the forward end of the shield body 1 for cutting and boring tunnel face ground G as driven by a motor or the like (not shown). A plurality set of tunnel wall reinforcing segments 22 are installed behind the shield body 1 continuous to the rearward end of the body. A feed pipe 5 for feeding such a fluid as water, slurry, muddy water or the like under a pressure into the hydraulic chamber 21 is connected to an upper position of the bulkhead 2 to open inside the chamber, whereas a drain pipe 6 is connected to a lower position of the bulkhead 2 for draining a mixture of the fed fluid and ground formations bored by the rotated cutter head 3 under a hydraulic condition maintained against tunnel face ground G and introduced into the hydraulic chamber 21.

Now, an exemplary excess excavation cavity 20 is shown in FIG. 1, which is often caused to occur when a soft and unstable ground is being bored specifically due to, for example, an unbalance of a locally varied underground pressure at the tunnel face with respect to a hydraulic pressure of the fed fluid to the tunnel face which is generally predetermined for tunneling course of the ground, an unbalance of propelling rate of the machine shield with respect to actually excavated and drained amount of the ground formations, which rate being determined generally in view of the drained ground formation amount, any sudden local change in the nature or condition of the tunnel face ground formations, or the like reason. Such excess excavation cavity 20 always expands in upward directions with respect to tunneling direction since collapsed ground fromations fall to the bottom of the tunnel face and, if such cavity is left above the reinforcing segments 22 installed along bored tunnel wall, the same may entail in further collapses of upper ground layers even up to the ground surface and the bored tunnel may even be thereby damaged.

In order to detect any occurrence of such excess excavation that happens as described above, the tunnel boring machine according to the present invention is provided, in the present instance, with a plurality of ultrasonic wave transmitting and receiving devices 7 through 12, in which the device 7 is positioned, for example, adjacent the forward end of the machine's shield body 1 so as to transmit ultrasonic waves substantially in vertically upward direction with respect to the axial line of the shield body 1, the device 8 at, for example, the peripheral edge of the rotary cutter head 3 so as to transmit the ultrasonic waves in a radial direction vertical to the axial line of the shield body 1 and the devices 9 through 12 on the front surface of the cutter head 3 substantially along a radial line thereof at, for example, the intermediate of a sector shaped area defined between adjacent rows of many cutting edges arranged in cross shape on the front surface as seen in FIG. 2. In the preferred embodiment, further, the devices 9 and 10 which are closer to the peripheral edge of the cutter head 3 are adapted to transmit the ultrasonic waves diagonally outward directions respectively at angles of, for example, 60° and 30° with respect to the axial line of the shield body 1 with which the rotary axis of the cutter head 3 is aligned, whereas the devices 11 and 12 closer to the axial line are disposed for transmitting the waves substantially in parallel directions to the axial line.

The respective ultrasonic wave transmitting and receiving devices 7 through 12 comprise an ultrasonic wave transmitter and a reflected ultrasonic wave receiver and are connected to a wave transmission and reception controlling unit 13 to which a transmission-to-reception time interval determining means 14 is connected. The devices 8 through 12 which are provided in the rotary cutter head 3 are connected to the unit 13 by means of a bus line 15 preferably passing through an axial hole 16 made in the rotary shaft 4 of the head 3 and including a rotary contacting means disposed at an appropriate position, so that the devices 8 through 12 will be actuated to transmit and receive the ultrasonic waves most preferably periodically while being rotated together with the cutter head 3 and the device 7 at stationary position of the shield body 1 will be also actuated in synchronism with the other devices.

While the devices 8 through 12 on the cutter head 3 are shown as provided only along a radial line of the head, it will be appreciated that they may be provided, for example, in all of the sector shaped areas on the front surface of the head so as to be crosswise, in which case all of the wave transmitting and receiving devices may be actuated once in each rotation of the cutter head 3. However, it will be appreciated that the most important is to detect the excess excavation occurring in the upper part of the tunnel face ground primarily, for which purpose the illustrated arrangement of the devices only along the single radial line and the actuation of them once in each of the cutter head's rotations when they are at the vertical upper position with respect to the axial line of the shield body 1 as shown in the drawings. The actuation of these ultrasonic wave transmitting and receiving devices may be performed continuously during the tunneling work as long as a proper measure for removing mutual interferences by ultrasonic waves transmitted from other devices and reflected from other points on the ground wall than those to which the respective devices are oriented is provided.

Referring next to FIG. 3, an exemplary mechanism of excess excavation detecting and measuring operation employed in the present invention shall be explained with reference to a block diagram only briefly since the respective parts may be of any known arrangements. In the drawing, a block 31 is an ultrasonic wave transmission and reception controlling unit, corresponding to the block 13 in FIG. 1, a block 32 represents the plurality of ultrasonic wave transmitting and receiving devices 7 through 12 shown in FIG. 1, blocks 33 and 34 are, for example, a gate circuit unit and a pulse counter unit, respectively, which are forming the time interval determining means 14 of FIG. 1 and a block 35 is such an operation unit as a measured value indicator or recorder, excess excavation alarming device, control device for the entire boring system or the like.

The ultrasonic wave transmission and reception controlling unit 31 simultaneously provides wave transmission signals to all of the wave transmitters in the unit 32 and also to all of gate circuits in the gate circuit unit 33 which are respectively connected to each of the reflected wave receivers in the unit 32, whereby the respective wave transmitters transmit the ultrasonic waves and the respective gate circuits are opened. The transmission signal is also given to clock pulse generating circuits in the controlling unit 31 so that clock pulses will be thereby generated and provided to the respective gate circuits in the unit 33. The gate circuits being opened by the transmission signal pass the clock pulses to the respective corresponding pulse counters in the unit 34. The ultrasonic waves thus transmitted from the unit 32 are reflected back from the tunnel face ground G to the respective wave receivers in the unit 32, upon which the receivers provide reception signals to the respective pulse generating circuits in the unit 31 so as to interrupt the pulse generation, whereby the gate circuits in the unit 33 are closed. The clock pulses passed through the gate circuits while they are opened and further to the respective pulse counters are counted therein and, depending on the numbers of the clock pulses counted until the gate circuits are closed by the reception signals, the pulse counter unit 34 provides output signals indicative of the ultrasonic wave transmitting and receiving time intervals detected by the respective transmitting and receiving devices, which signals are presented to the operation unit 35 so as to have the signals visually indicated, to cause an alarming signal generated if an excess excavation is detected, to control the boring system properly depending on the thus detected state of the tunnel face ground wall, or to have the detected and measured values recorded and so on by the unit 35. It will be readily appreciated that, in visually indicating or recording the measured time interval signals with the unit 35, the signals can be utilized as the ones indicative, as they stand, of actual distances between the respective wave transmitting and receiving devices and the respective points on the tunnel face ground wall opposing the devices, and further that actual shape of the tunnel face ground wall may be visually indicated on an oscillograph or the like if the respective signals are plotted thereon properly depending on the respective locations of the wave transmitting and receiving devices with respect to the center of the rotary cutter head or of the machine's shield body.

Referring now to FIG. 4, the respective signals indicating the wave transmitting and receiving time intervals detected and measured by the respective wave transmitting and receiving devices 9–12 during a rotation of the cutter head for 180° are plotted on the diagram of FIG. 4, in which the time intervals are taken on the abscissa and angles of rotation of the cutter head are taken on the ordinate. Respective curves identified by references TR9 through TR12 represent the respective measurements of the time intervals, or of the distances, detected by the wave transmitting and receiving devices 9 through 12 in the event when the detecting and measuring operation is continuously or periodically performed while the rotary cutter head 3 with the devices 9 through 12 is rotated from the position illustrated in FIG. 1 to an opposite position thereto by angles of 180° and where the tunnel face ground G involves such excess excavation as, for example, the cavity 20 shown also in FIG. 1. It is seen from the diagram that, since the excess excavation occurs in the upper part of the tunnel face ground G, the measurement curves of the transmitting and receiving devices at closer positions to the periphery of the cutter head are caused to vary to a large extent, whereas the curves will be substantially flat in the event where no excess excavation occurs.

In order to determine the height of the ground wall of the excess excavation cavity 20, the measurements of the device 9 typically as shown by the curve TR9 in FIG. 4 are multiplied by sin 60°, results of which are shown by a curve TR9 (sin 60°) in FIG. 5 of a diagram in which the heights are taken on the abscissa and the angles of rotation of the cutter head are taken on the ordinate. Measurements of the wave transmitting and receiving device 8 disposed at the periphery of the cutter head are plotted as they are in the diagram of FIG. 5 as shown by a curve TR8, since the measurements are representative of the height of the ground wall with respect to the periphery of the cutter head. Measurements of the stationary device 7 disposed adjacent the forward end of the shield body 1 of the boring machine are directly representative of the height and, if these measurements are plotted in the diagram of FIG. 5, resulting curve will be substantially flat subject to its level differences depending on the state of the ground wall.

According to the present invention, as has been described in the above, the occurrence of the excess excavation in the tunnel face ground being bored can be promptly detected without substantial delay through the tunnel boring work has to be performed in blind condition for operators of the boring machine with respect to the state of the ground, since the machine is provided with such detecting means as the ultrasonic wave transmitting and receiving devices. As the measurements of such detecting means can be utilized even for visually indicating the shape, scale, location and so on of the occurred excess excavation, the operators can grasp the state of the excess excavation immediately so that any proper measure against the occurred excess excavation can be promptly taken. As the measurements can be further utilized as signals for controlling the hydraulic tunnel boring system in response to thus detected state of any excess excavation occurred in the tunnel face ground, the system can be operated even as automated while continuously watching the state of the tunnel face ground being bored and performing any proper measure against the excess excavation.

While in the foregoings only the embodiment wherein the ultrasonic waves are employed for the detection and measurement of the excess excavation has been described, it will be appreciated that the ultrasonic wave transmitting and receiving device may be substituted by any other means which generates, generally, high frequency oscillations having high directivity such as electromagnetic waves including, for example, laser beam. Further, it may be also possible that the detecting means of the present invention is provided only in the rotary cutter head or only at positions on the cutter head closer to the periphery thereof.

What we claim as our invention is:

1. A shield type tunnel boring machine comprising a substantially cylindrical shield body having adjacent an axial end a bulkhead, a rotary cutter head centrally supported by said bulkhead for cutting and boring opposing tunnel face ground, means provided at least in said cutter head for transmitting high frequency oscillations towards the tunnel face ground wall and for receiving oscillations reflected from said ground wall wherein a plurality of said oscillation transmitting and receiving means are provided at least along a radial line on the outer surface of said rotary cutter head facing the tunnel face ground and spaced from one another, said plurality of oscillation transmitting and receiving means including ones for transmitting the oscillations from positions adjacent the periphery of the cutter head in diagonally outward directions with respect to an axial line of said shield body and ones for emitting the oscillations from positions adjacent the center of the cutter head in parallel directions to said axial line, and means connected to said oscillation transmitting and receiving means for determining the oscillation transmitting and receiving time interval.

2. A machine according to claim 1 further including means for transmitting and receiving high frequency oscillations provided in said shield body at a position adjacent said rotary cutter head and oriented to transmit oscillations in a vertically upward direction with respect to an axial line of the shield body.

3. A machine according to claim 1 wherein said oscillations are ultrasonic waves.

4. A machine according to claim 1 wherein said oscillations are electromagnetic waves.

5. A machine according to claim 1 wherein said diagonally outward directions are angled by 30° and 60° with respect to the axial line of the shield body.

6. A machine according to claim 1 wherein said plurality of oscillation transmitting and receiving means include one disposed at the periphery of the rotary cutter head and oriented in a vertical radial direction with respect to the axial line of the shield body.

7. A hydraulic tunnel boring machine comprising a substantially cylindrical shield body closed adjacent an axial end by a bulkhead defining a hydraulic chamber between a tunnel face ground and said bulkhead, a rotary cutter head disposed at said end of the shield body as born by the bulkhead for hydraulically cutting and boring said tunnel face ground, means for feeding a hydraulic material to said hydraulic chamber, means for discharging a mixture of said hydraulic material and bored ground formations out of the hydraulic chamber and bored tunnel, a plurality of ultrasonic wave transmitting and receiving devices provided at least in the cutter head and spaced from each other at least along a radial line in the head and oriented generally towards the tunnel face ground, a part of said plurality of transmitting and receiving devices disposed at positions closer to the center of the cutter head being oriented in parallel directions with the axial line of the shield body, another part of the devices disposed at positions closer to the periphery of the cutter head being oriented in outward directions with gradually increased angles with respect to the axial line of the shield body, and at least a remaining one of the devices disposed at the periphery of the cutter head being oriented in a vertically radial direction with respect to the axial line of the shield body, a wave transmission and reception controlling means connected to respective said ultrasonic wave transmitting and receiving devices, said controlling means providing to the respective devices a transmission signal for causing the ultrasonic waves to be generated and transmitted by the devices and receiving from the respective devices signals indicating receptions of the waves reflected from the tunnel face ground, means connected to said controlling means for determining time intervals between said transmission signal and said reception indicating signals of the respective ultrasonic wave transmitting and receiving devices, and means connected to said time interval determining means for recording said wave transmitting and receiving time intervals of the respective transmitting and receiving devices as distances from the devices to respective points on the tunnel face ground to which the devices are opposing.

* * * * *